United States Patent [19]

Azuma

[11] 4,023,236

[45] May 17, 1977

[54] DUAL-ROLLER SUPPORT FOR OVERHUNG DOORS

[75] Inventor: Akira Azuma, Uozu, Japan

[73] Assignee: Yoshida Kogyo K.K., Tokyo, Japan

[22] Filed: Oct. 20, 1975

[21] Appl. No.: 624,227

[30] Foreign Application Priority Data

Oct. 21, 1974 Japan ..... 49-127199

[52] U.S. Cl. ..... 16/97; 16/102

[51] Int. Cl.[2] ..... A47H 15/00

[58] Field of Search ..... 16/97, 102, 107, 94 R, 16/95 R, 96 R, 98

[56] References Cited

UNITED STATES PATENTS

| | | | |
|---|---|---|---|
| 1,222,876 | 4/1917 | Lewson | 16/102 |
| 2,283,359 | 5/1942 | Gaboury | 16/97 |
| 2,732,929 | 1/1956 | Delaney | 16/97 |
| 3,553,765 | 1/1971 | Frost | 16/107 |

FOREIGN PATENTS OR APPLICATIONS

| | | | |
|---|---|---|---|
| 1,443,405 | 5/1965 | France | 16/102 |

*Primary Examiner*—George H. Krizmanich
*Attorney, Agent, or Firm*—Hill, Gross, Simpson, Van Santen, Steadman, Chiara & Simpson

[57] ABSTRACT

For suspending a sliding door from a pair of parallel spaced overhead tracks, there is provided a dual-roller support comprising first and second separate sections each comprising a roller and its mount. Only the first section is directly affixed to the top edge of the door. Thus, for installation of the door, the roller of the first section is first manipulated into rolling engagement with one of the overhead tracks thereby temporarily suspending the door therefrom. The second section is then bolted to the first section, with the roller of the second section in rolling engagement with the other overhead track.

3 Claims, 3 Drawing Figures

DUAL-ROLLER SUPPORT FOR OVERHUNG DOORS

BACKGROUND OF THE INVENTION

1. Field of Invention

This invention relates to rolling supports for overhung doors, and in particular to a dual-roller support for use in suspending a door from a pair of overhead tracks or rails which are arranged in parallel spaced relationship.

2. Prior Art

The dual-roller supports for overhung doors, as heretofore made, are of such construction that for installation of the door, the supports alone must first be suspended from the overhead tracks or rails. The door is then screwed or otherwise fastened to the supports while being manually raised off the floor. This conventional manner of door installation requires the joint effort of at least two workers, one for holding the door and the other for fastening the door to the supports, and is highly troublesome and time-consuming. For removal, too, the door must be held by one worker as the other worker unscrews the fasteners for the same from the supports.

SUMMARY OF THE INVENTION

It is an object of this invention to provide an improved dual-roller support for use in suspending a door from a pair of overhead tracks, which permits a worker to single-handedly install the door in, and remove the same from, its working position under the overhead tracks through a highly simplified procedure.

With this and other objects in view this invention is directed, in brief, to the provision of a dual-roller support which is broadly constituted of two separate sections. One of the sections comprises a first roller for rolling engagement with one of the overhead tracks, a first mount for rotatably supporting the first roller, and means for securing the first mount to the top edge of a door. The other section comprises a second roller for rolling engagement with the other overhead track, and a second mount for rotatably supporting the second roller.

For installation of the door the first mount with the first roller thereon is first screwed or otherwise secured to the door. This door is then raised to engage the first roller with one of the overhead tracks. With the door thus temporarily suspended solely from the one overhead track, the worker may proceed, totally unassisted, to fasten the second mount to the first mount by engaging the second roller with the other overhead track. It is easy to remove the door from, and re-install the same in, its working position for lubrication or change of the dual-roller supports.

The features which are believed to be novel and characteristic of this invention are set forth in particular in the appended claims. The invention itself, however, both as to its general organization and the functions of the individual parts, together with the further objects and advantages thereof, will be apparent from a consideration of the following description, with reference had to the accompanying drawings in which like reference characters refer to like parts throughout.

DESCRIPTION OF THE PREFERRED EMBODIMENTS

Figure 1:
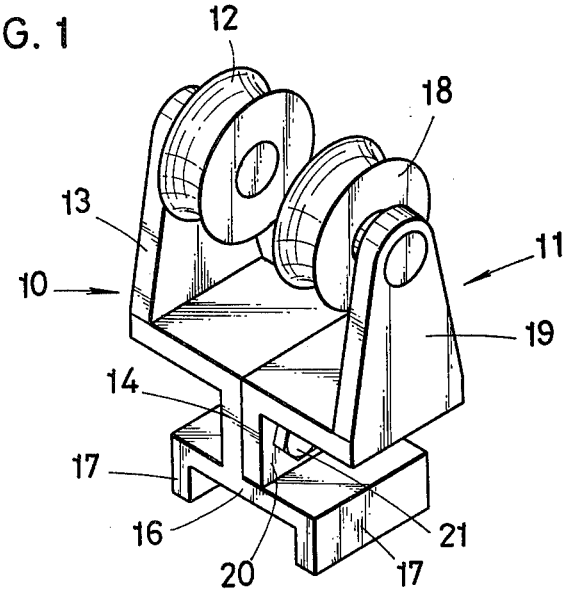
FIG. 1 is a perspective view of a dual-roller support embodying this invention.
Figure 2:
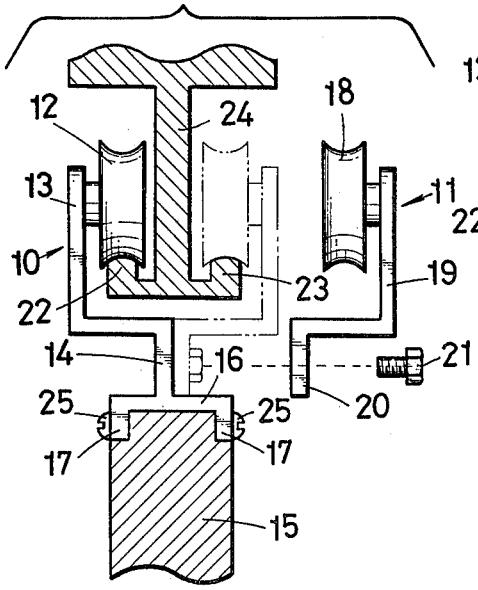
FIG. 2 is an exploded end view of the dual-roller support of FIG. 1, the view being explanatory of the way a door is suspended from a pair of overhead tracks by the support, with the door and overhead tracks shown in partial vertical cross-section.

A dual-roller support according to this invention is illustrated in FIGS. 1 and 2. The dual-roller support broadly comprises first and second sections 10 and 11 which are separable from each other. The first support section 10 includes a roller 12 rotatably supported on an L-shaped portion of a mount 13. This mount includes a web 14 extending downwardly therefrom. For securing the mount 13 to the top edge of a door 15, a mounting plate 16 having a pair of opposed jaw-like flanges 17 is formed at the bottom end of the web 14.

The second support section 11 likewise includes a roller 18 rotatably supported on a mount 19 similar to the first recited mount 13. The mount 19 includes a flange 20 which extends downwardly therefrom and which corresponds to the web 14 of the first support section 10. The mount 19 with its roller 18 can be removably attached to the mount 13 by means of a tap bolt 21 or other suitable fasteners.

The dual-roller support of the foregoing construction is constructed for use with a pair of overhead tracks or rails 22 and 23 arranged on the opposite sides of, and extending along, a web 24.

For suspending the door 15 from the overhead tracks 22 and 23, the top edge of the door is first fitted between the jaw-like flanges 17 on the mounting plate 16 of each dual-roller support and secured thereto as by slotted-headed screws 25. At this juncture, the second support section 11 is not yet fastened to the first support section 10. The door 15 is then manually raised to place the roller 12 of each first support section 10 upon the overhead track 22 for rolling engagement with the latter.

With the door 15 thus tentatively suspended from the overhead track 22 by the first support section 10, the second support section 11 may now be secured to the first section by bolting or otherwise fastening together the web 14 and the flange 20, while the roller 18 of the second section is held in rolling engagement with the track 23. The door 15 can thus be readily and securely suspended from the overhead tracks 22 and 23 for rolling movement therealong. The rollers 12 and 18 of this first species are disposed opposite to or face each other when the mounts 13 and 19 are fastened together.

Figure 3:
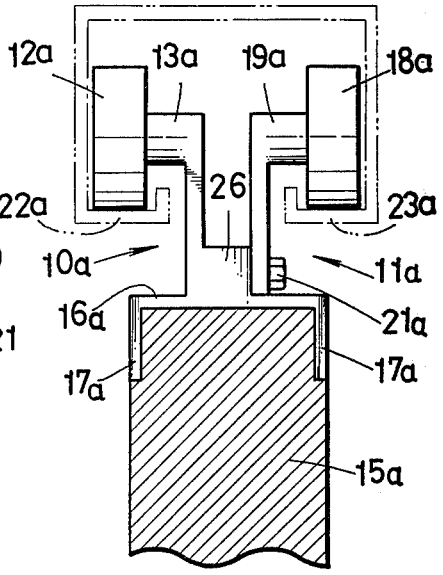
FIG. 3 is an end elevational view of another embodiment of the invention which is adapted for use in suspending a door, which is shown in partial vertical cross-section, from a different type of overhead tracks.

FIG. 3 illustrates another preferred embodiment of the invention which is adapted for use with a pair of overhead tracks **22*a* and 23*a* having a downwardly open space therebetween. This embodiment also comprises first and second support sections 10*a* and 11*a*. The first support section 10*a* includes a roller 12*a* rotatably supported on an inverted-L-shaped mount 13*a*. The mount 13*a* has a thickened portion 26 at its lower end, and the mounting plate 16*a* complete with the pair of jaw-like flanges 17*a* is formed under the thickened portion 26 for securing the mount 13*a* to the door 15*a***.

The second support section 11*a* includes a roller 18*a* rotatably supported on a mount 19*a* similar to the mount 13*a*. The mount 19*a* can be attached to the thickened portion 26 of the mount 13*a* as by a tap bolt 21*a*.

For installation of the door 15 the first support section 10*a* that has been secured to the door is directed upwardly through the downwardly open space between the overhead tracks 22*a* and 23*a* so that the roller 12*a* of the first support section may be placed upon the track 22*a* for rolling engagement therewith. The roller 18*a* of the second support section 11 is then similarly manipulated into engagement with the other overhead track 23*a*, and its mount 19*a* is bolted or otherwise fastened to the thickened portion 26 of the mount 13*a*. In this second species the rollers 12*a* and 18*a* face away from each other when the mounts 13*a* and 19*a* are fastened together.

The objects as above stated are believed to have been fully realized in the preferred forms of the dual-roller support shown and described hereinbefore. It is understood, however, that the invention itself is not to be restricted to the exact structural details disclosed but is inclusive of numerous modifications which will readily occur to persons skilled in the art, without departing from the spirit or scope of the following claims.

What is claimed is:

1. A dual-roller support adapted to suspend a door from a pair of parallel spaced overhead tracks, comprising in combination:

a. a first roller for rolling engagement with one of the overhead tracks;

b. a first mount rotatably supporting said roller at its upper end, said first mount having an inverted U-shaped channel portion integral with its lower end and receptive of the upper marginal portion of the door and adapted to be secured thereto, said first mount having a first vertical portion interconnecting the central portion of said inverted U-shaped channel portion with said upper end, whereby said first vertical portion will be disposed in a plane intermediate the overhead tracks;

c. a second roller for rolling engagement with the other of the overhead tracks;

d. a second mount rotatably supporting said second roller at its upper end, said second mount having a second vertical portion at its lower end adapted to be secured directly against said first vertical portion; and e. means fastening said second mount to said first mount, said means passing through said second vertical portion into said first vertical portion;

whereby, said door can be first suspended from said one overhead track by said first roller and first mount, and said second mount with said second roller can be thereafter installed and fastened to said suspended first mount.

2. A dual-roller support according to claim 1, each of said first and second rollers having peripheral configurations which comprise means, coactive with the cross-sectional configuration of the tracks, for severally positively resisting lateral displacement of each roller from each track.

3. A dual-roller support according to claim 1, adapted for use with overhead tracks having a downwardly open space therebetween, said first and second rollers being projected by said mounts away from each other when said first and second mounts are fastened together.

* * * * *